US005669575A

United States Patent [19]

Byle

[11] Patent Number: 5,669,575

[45] Date of Patent: Sep. 23, 1997

[54] APPARATUS FOR CONTROLLING A CABLE ON A TAKE-UP DRUM

[75] Inventor: Darryl S. Byle, Kalispell, Mont.

[73] Assignee: The United States of America as represented by the Secretary of the Navy, Washington, D.C.

[21] Appl. No.: 564,674

[22] Filed: Nov. 29, 1995

[51] Int. Cl.[6] ..... B65H 54/553

[52] U.S. Cl. ..... 242/470; 242/547; 254/333

[58] Field of Search ..... 242/470, 547, 242/541.5; 254/333

[56] References Cited

U.S. PATENT DOCUMENTS

| | | | |
|---|---|---|---|
| 603,250 | 5/1898 | Bessonette | 242/541.5 X |
| 743,631 | 11/1903 | Fuqua | 242/547 X |
| 1,032,799 | 7/1912 | Adams | 242/547 |
| 3,353,793 | 11/1967 | Nelson | 254/333 |
| 3,425,641 | 2/1969 | Gallet et al. | 242/547 |
| 3,780,538 | 12/1973 | Mann . | |
| 4,023,744 | 5/1977 | Shutt . | |
| 4,103,841 | 8/1978 | Flynn et al. | 242/547 X |
| 4,421,284 | 12/1983 | Pan . | |
| 4,447,013 | 5/1984 | Sandered et al. . | |
| 4,461,554 | 7/1984 | Norris et al. | 254/333 X |
| 4,557,465 | 12/1985 | Lundberg | 254/287 |
| 4,634,102 | 1/1987 | Appling et al. | 254/278 |
| 4,681,301 | 7/1987 | Rinio | 254/333 |
| 4,706,586 | 11/1987 | Vogt et al. | 242/547 X |
| 4,706,940 | 11/1987 | Harig | 254/333 |
| 4,721,285 | 1/1988 | McMichael | 254/333 |
| 4,830,300 | 5/1989 | Taylor et al. . | |
| 4,842,207 | 6/1989 | Kinnan . | |
| 4,953,829 | 9/1990 | Knaack et al. | 254/333 |

*Primary Examiner*—Daniel P. Stodola
*Assistant Examiner*—Gregory J. Strimbu
*Attorney, Agent, or Firm*—John Tarlano; Darrell Hollis

[57] ABSTRACT

Apparatus that controls its cable on its cable take-up drum, the apparatus including pressure rollers supported by flexible spring steel members, a flexible spring steel member around each end of the cable take-up drum, two ends of each flexible member being pulled together by a pair of adjustable links, the pressure rollers applying pressure on the cable as the cable is being wound on to or off of the cable take-up drum.

2 Claims, 5 Drawing Sheets

APPARATUS FOR CONTROLLING A CABLE ON A TAKE-UP DRUM

FIELD OF THE INVENTION

The present invention relates to an apparatus for controlling a cable during a take-up of a cable onto a take-up drum, or an unwrapping of the cable off of the take-up drum.

BACKGROUND OF THE INVENTION

In the past, a take-up drum has been used to take-up or unwrap a cable. However, should the speed of the cable become greater, and then less, than the speed of the take-up drum during take-up or unwrapping of the cable, the cable might tangle, and thus not be aligned uniformly on the take-up drum.

U.S. Pat. No. 4,953,829 shows a pressure roller for applying a force per unit area to a point on a cable, the point being near to where the cable is being wound onto or off of a take-up drum. The roller is on a member. The member is urged toward the take-up drum by means of force from a bent leaf spring.

U.S. Pat. No. 4,706,940 shows two pressure rollers that apply a force per unit area to a cable, the force coming from a compressed spring device. The compressed spring device applies the force to a straight member, the rollers being on the straight member. The pressure rollers apply the force per unit area to the cable, as it comes onto or goes off of a rope hoist mechanism. The compressed spring device will allow the force per unit area to be applied to the cable as the cable comes onto or goes off of the rope hoist mechanism. The force per unit area is applied at points near to where the cable comes onto or goes off of the the rope hoist mechanism.

U.S. Pat. No. 4,721,285 shows a plurality of sets of rollers at a plurality of unevenly spaced points around an inflatable member. The inflatable member causes an adjustible pressure to be applied on itself from the rollers. The rollers are not on flexible members. One or more adjustable links are not used to link one or more flexible members and thus allow the rollers to provide an adjustable pressure to a cable.

The use of an adjustable link, and pressure rollers that uniformly surround a take-up drum, to apply an adjustable force per unit area, or pressure, to points on the cable, uniformly around the take-up drum cable, is not shown or suggested.

The present invention is a means for preventing a cable from becoming tangled, as the cable is wound onto or unwrapped off of a take-up drum. Such tangling may be referred to as "birds-nesting". In the present invention, in its various aspects, a selected amount of force per unit area is applied through a member or members of a support means, and then through several pressure rollers, at a plurality of uniformally spaced points on a cable that is being wrapped onto or unwrapped off of a take-up drum. The rollers are rotatably attached between a support means that are at each end of the take-up drum. The disclosed apparatus also assists in an even alignment of the cable, while the cable is being taken up by the take-up drum.

The force per unit area that is applied to the cable through the rollers, comes from the use of one or more adjustable links. Such an adjustible link has a stretched spring. The force produced by the spring is adjustable, depending on the initial amount by which the spring is stretched. The adjustable link is connected to members that hold such rollers. The force per unit area on the rollers assists in untangled wrapping, of the cable onto the take-up drum, or untangled unwrapping, of the cable off of the cable take-up drum.

The pressures exerted by pressure rollers are made to oppose one another, uniformly around the take-up drum. The pressures from the rollers are distributed uniformly on the coil that is around the take-up drum.

Each roller has a correspondingly opposing roller at 180 degrees from the former roller. That is, a roller would be at a point opposite to another roller, both such rollers being against the take-up drum. There would be an opposing force to a force on each roller. The opposing force is on a roller opposing a first roller. The opposing forces would distribute the total force from the adjustable link uniformly around the coil, that is being wrapped onto or unwrapped off of the take-up drum.

The number of rollers that is used in the disclosed apparatus would be a number N, N being greater than 2, so that the forces on the rollers produce stably balanced pressures on the coil. If N is equal to 3, the three rollers would be spaced 120 degrees from one another. If N is equal to 4, the four rollers would be spaced 90 degrees from one another. If N is equal to 5, the five rollers would be spaced 72 degrees from one another.

In a first preferred embodiment of the present invention, two curved members rotatably hold a multiple number of pressure rollers at points that are around a take-up drum on which cable is being wrapped. The two curved members are pulled together by means of an adjustable link that has a spring that is adjustably stretched. The pressure rollers put a selected amount of force per unit area on the cable, as the cable is being wrapped around the take-up drum. The members pivot on a common pin that is connected to a base. The pin is held to the base by a horse-shoe shaped member. A selected amount of force per unit area is applied from the pressure rollers to the cable that is being wrapped onto or unwrapped off of the take-up drum.

In a second alternate embodiment of the present invention, a single flexible curved member rotatably holds a multiple number of pressure rollers at points on a cable, the points being around the take-up drum. The member is linked at each of its ends by an adjustable link. Each adjustable link has a spring that is adjustably stretched. The adjustable links are linked to a common pin at a pivot point. The pin is held to a base by a horse-shoe shaped member. A selected amount of force is applied by the adjustible links to the flexible member and thus to the pressure rollers. The pressure rollers put balanced pressures at points on the cable.

SUMMARY OF THE INVENTION

Apparatus for controlling a cable on a take-up drum, comprising a cable take-up drum having a cylindrical outer surface of a prescribed length, a cable wrapped around a portion of the length of the take-up drum, roller means for applying a pressure to the cable at a plurality of points that are uniformly around the take-up drum, the roller means extending substantially the length of the take-up drum, first and second support means being adjacent to first and second ends of the take-up drum for rotatably supporting the roller means, the first and second support means having first and second link means for pulling the first and second support means together with an adjustable force, to cause the roller means to apply an adjustable pressure on the cable.

DESCRIPTION OF THE PREFERRED EMBODIMENT

Figure 1:
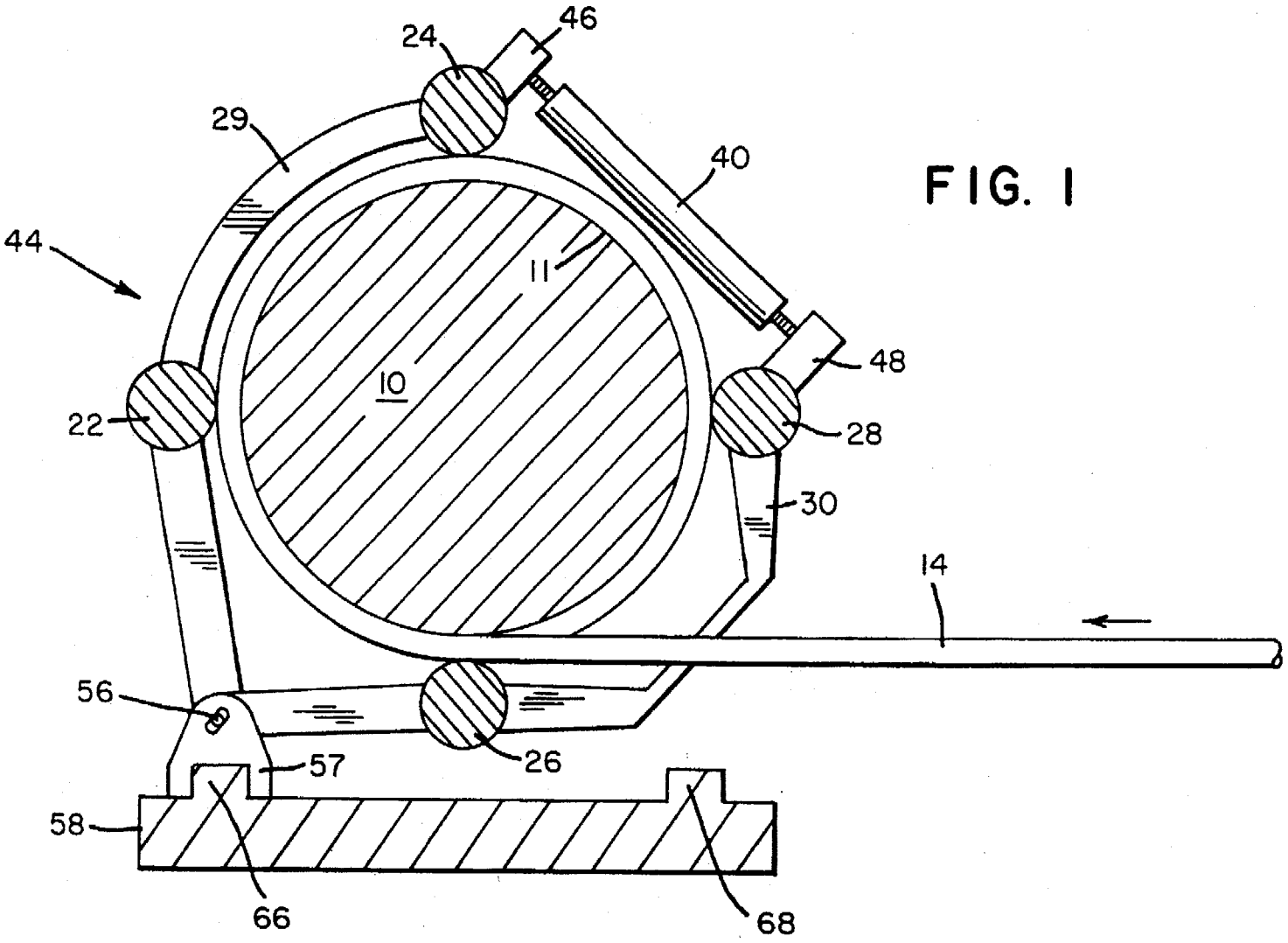
FIG. 1 is a sectional view of two cantilevered members rotatably holding rollers thereon, the members joined together by an adjustable link, the rollers putting a selected force on a cable being taken up on a take-up drum.

In FIG. 1 a cylindrical take-up drum 10 has an outer surface 11. The cylindrical take-up drum 10 is rotated in a clock wise direction, to take up a cable 14 onto the outer surface 11 of the cylindrical take-up drum 10. In order to prevent the cable 14 from becoming tangled, as the cable 14 is pulled onto or unwrapped off of the cylindrical take-up drum 10, pressure rollers 22, 24, 26 and 28 are used. The pressure rollers can be made of a material that will apply an even pressure to cable 14. For a steel cable 14, the pressure rollers could be made of brass or hard rubber.

A cantilevered flexible member 29 rotatably supports one end of pressure rollers 22 and 24. A cantilevered flexible member 30 rotatably supports one end of pressure rollers 26 and 28. Cantilevered flexible members 29 and 30 and an adjustable link 40 together form a support means 44, also known as a roller mounting unit. Cantilevered flexible members 29 and 30 can be made out of a flexible material such as spring steel.

Figure 2:
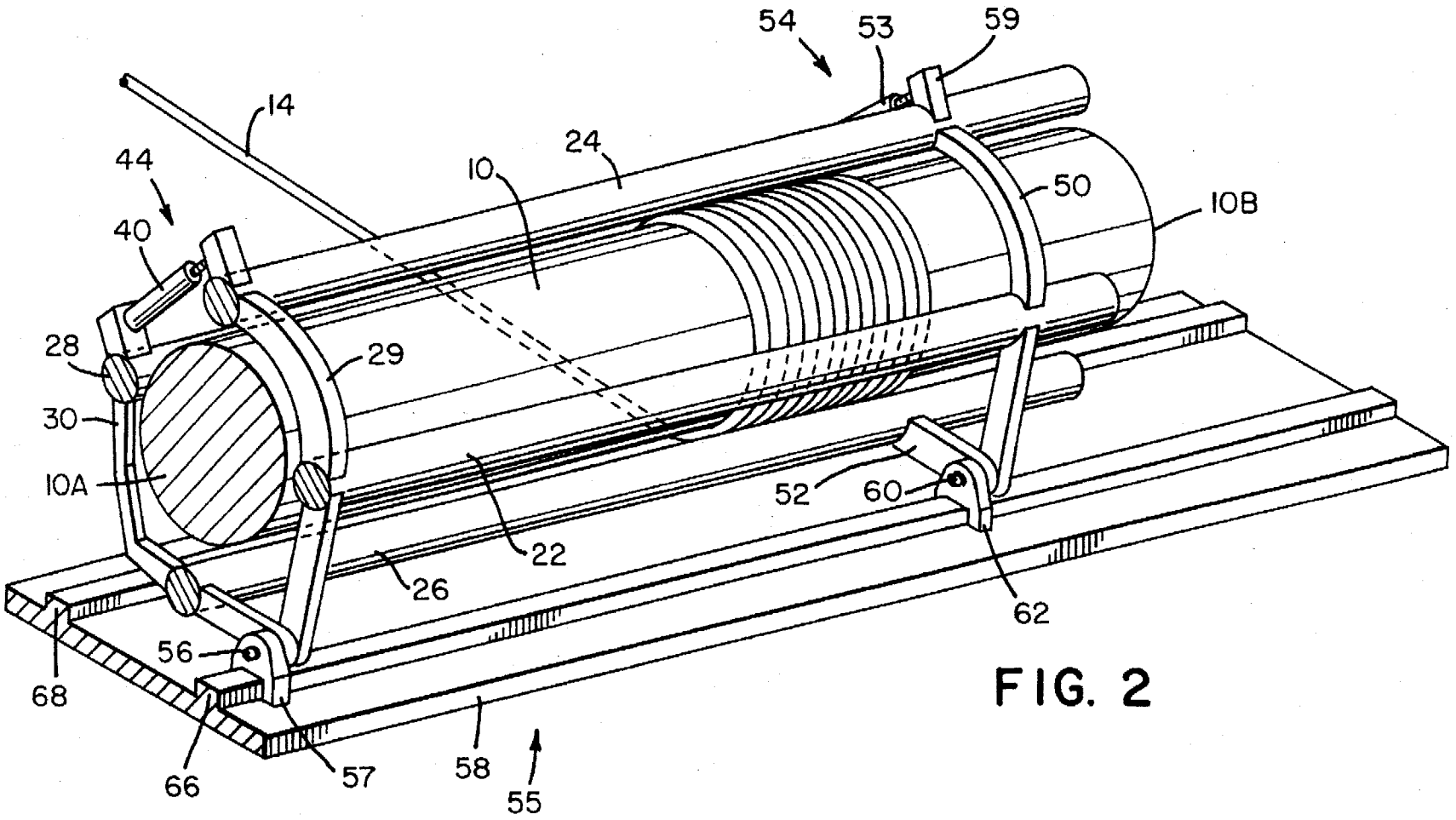
FIG. 2 is a perspective view of apparatus for aligning a cable, the apparatus having two cantilevered members, as shown in FIG. 1, at each end of a roller.

A cantilevered flexible member 50, as shown in FIG. 2, rotatably supports the other end of flexible rollers 22 and 24. Cantilevered flexible member 52, also shown in FIG. 2, rotatably supports the other end of flexible rollers 26 and 28. Cantilevered flexible members 50 and 52 and adjustable link 53 together form a support means 54, also known as a roller mounting unit.

FIG. 2 shows apparatus 55 for controlling cable 14. The pressure rollers 22, 24, 26 and 28 rotate and put an adjustable pressure on cable 14 as cable 14 goes onto or comes off of cylindrical take-up drum 10. The pressure rollers 22, 24, 26 and 28 put the adjustable force per unit area on the cable 14 at points that are uniformly around the cylindrical take-up drum 10.

As shown in FIG. 1, the pressure roller 26 pushes on cable 14 near a point at which cable 14 first touches cylindrical take-up drum 10. Pressure rollers 22, 24 and 28 are at intervals, clockwise, of 90 degrees, 180 degrees and 270 degrees, respectively, from pressure roller 26. The pressure rollers 22, 24 , 26 and 28 thus put pressure on cable 14 at length-wise regions around cylindrical take-up drum 10. The length-wise regions are parallel to the central axis of cylindrical take-up drum 10.

The adjustable link 40, such as a spring type adjustable link, pulls cantilevered flexible members 29 and 30 together. That is, adjustable link 40 pulls together end 46 of cantilevered flexible member 29 and end 48 of cantilevered flexible member 30, with an adjustable force.

The cantilevered flexible members 29 and 30 rotate around a pin 56. Pin 56 acts as a fixed point of rotation. Pin 56 rides in a slot of U-shaped member 57. The slot is lengthened to allow for some movement, or "play", of pin 56 in the slot. The U-shaped member 57 rides on raised strip portion 66 of base member 58. Base member 58 can also support means that rotatably support ends of the cylindrical take-up drum 10 (not shown).

The force that causes cantilevered flexible members 29 and 30 to rotate around pin 56 may be adjusted by adjusting adjustable link 40, so that the cable 14 is reeled evenly on cylindrical take-up drum 10, but such that there is no unnecessary drag on cable 14.

As shown in FIG. 2, the adjustable link 53, such as a spring type adjustable link, pulls cantilevered flexible members 50 and 52 together. That is, adjustable link 53 pulls together end 59 of cantilevered flexible member 50 and other end (not shown) of cantilevered flexible member 52, with an adjustable force. The cantilevered flexible members 50 and 52 can be made of a flexible material such as spring steel.

The cantilevered flexible members 50 and 52 rotate around a pin 60. Pin 60 acts as a fixed point of rotation. Pin 60 rides in a lengthened slot in U-shaped member 62. The U-shaped member 62 rides on, and is attached to, raised strip portion 66 of base member 58.

The force that causes cantilevered flexible members 50 and 52 to rotate around pin 60 may be adjusted by adjusting adjustable link 53, so that the cable 14 is reeled evenly on cylindrical take-up drum 10, but such that there is no unnecessary drag on cable 14.

As shown in FIG. 2, the cantilevered flexible member 29, the cantilevered flexible member 30, and the adjustable link 40, taken together, curve around the cylindrical take-up drum 10, near an end 10A of the cylindrical take-up drum 10. As shown in FIG. 2, the cantilevered flexible member 50, the cantilevered flexible member 52, and the adjustable link 53, taken together, curve around the cylindrical take-up drum 10, near an end 10B of the cylindrical take-up drum 10.

U-shaped members 57 and 62 can be moved to various points on raised strip portion 66 of base member 58, to move support means 44 and 54 to various locations over cylindrical take-up drum 10. U-shaped members 57 and 62 could alternatively be attached to raised strip portion 68 of base member 58.

Figure 3:
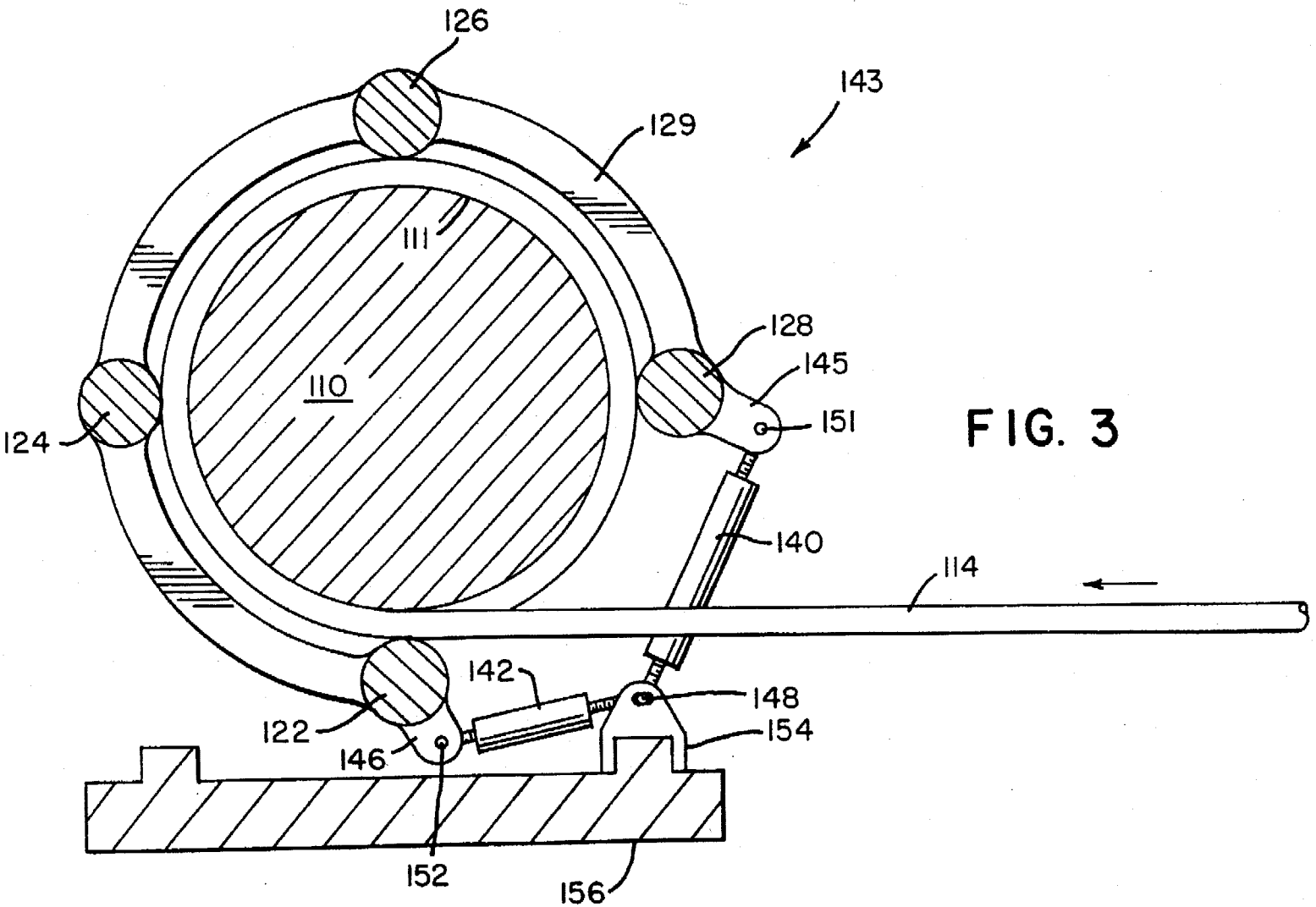
FIG. 3 is a sectional view of a single curved flexible member that rotatably holds rollers thereon, the ends of the member connected to a common pin by adjustable links, the rollers putting a selected force on a cable being taken up on a take-up drum.

In FIG. 3, a cylindrical take-up drum 110 has a surface 111. The cylindrical take-up drum 110 rotates in a clockwise direction to take up a cable 114 onto the surface 111 of the cylindrical take-up drum 110. In order to prevent the cable 114 from becoming tangled as the cable 114 is pulled onto the cylindrical take-up drum 110, or unwrapped off of cylindrical take-up drum 110, pressure rollers 122, 124, 126 and 128 are used.

Flexible member 129 rotatably supports one end of pressure rollers 122, 124, 126 and 128. The flexible member 129 and adjustable links 140 and 142 together form a support means 143, also known as a roller mounting unit.

Figure 4:
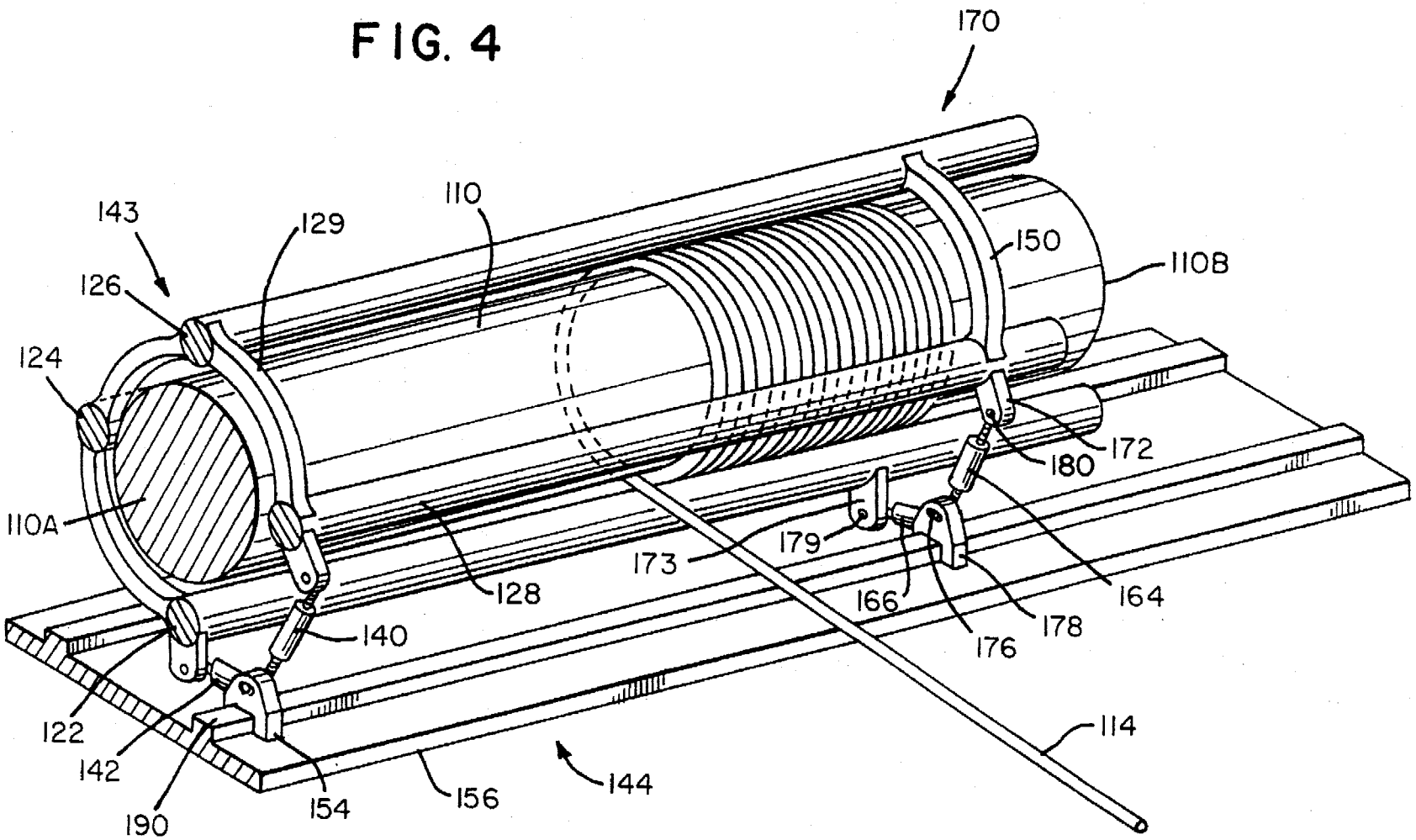
FIG. 4 is a perspective view of apparatus for aligning a cable, the apparatus having a single curved flexible member, as shown in FIG. 3, at each end of a roller.

FIG. 4 shows apparatus 144 for controlling cable 114. Flexible member 150, shown in FIG. 4, rotatably supports the other end of pressure rollers 122, 124, 126 and 128. The flexible member 150 and adjustable links 164 and 166 together form a support means 170, also known as a roller mounting unit.

The pressure rollers 122, 124, 126 and 128 rotate and put an adjustable pressure on cable 114, as cable 114 goes onto or comes off of cylindrical take-up drum 110. The pressure rollers 122, 124, 126 and 128 put the adjustable pressure on the cable 114 at points that are around the cylindrical take-up drum 110.

As shown in FIG. 3, the pressure roller 122 puts pressure on cable 114 at a point at which cable 114 first touches cylindrical take-up drum 110. Pressure rollers 124, 126 and 128 are at intervals, clockwise, of 90 degrees, 180 degress and 270 degrees, respectively, from pressure roller 122.

The adjustable links 140 and 142 are made to pull ends 145 and 146 of flexible member 129 together to form support means 143. The adjustable links 140 and 142 are connected together by pin 148. The adjustable links 140 and 142 are attached to flexible member 129 by means of pins 151 and 152.

Pin 148 acts as a fixed point about which adjustable links 140 and 142 rotate. Pin 148 rides in a lengthened slot of U-shaped member 154. The U-shaped member 154 rides on raised strip portion 190 of base member 156. Base member 156 can also support means for rotatably supporting the take-up drum 110.

As shown in FIG. 4, the adjustable links 164 and 166 are made to pull end 172 and the end 173 of flexible member 150 together to form support means 170. The adjustable links 164 and 166 are connected together by pin 176. The adjustable links 166 and 164 are attached to flexible member 150 by means of pins 179 and 180.

Pin 176 acts as a fixed point about which adjustable links 164 and 166 rotate. Pin 176 rides in a hole of U-shaped member 178. The U-shaped member 178 rides on strip 190 of a base member 156.

FIG. 4 shows the flexible member 129, described in relation to FIG. 3. Flexible member 129 is adjustably pulled together by adjustable links 140 and 142. FIG. 4 also shows flexible member 150. Flexible member 150 is adjustably pulled together by adjustable links 164 and 166. Pressure rollers 122, 124, 126 and 128 extend along cylindrical take-up drum 110. Flexible members 129 and 150 can be made out of a flexible material such as spring steel.

As shown in FIG. 4, the flexible member 129, adjustable link 140 and adjustable link 142 curve around cylindrical take-up drum 110 near end 110A of the cylindrical take-drum 110. As shown in FIG. 4, the flexible member 150, adjustable link 164 and adjustable link 166 curve around cylindrical take-up drum 110 near end 110B of cylindrical take-up drum 110. Again, the flexible members 129 and 150 could be made from spring steel. The U-shaped members 154 and 178 may be moved to various points of raised portion 190 of base member 156, to move support means 143 and 170 along cylindrical take-up drum 110.

Figure 5:
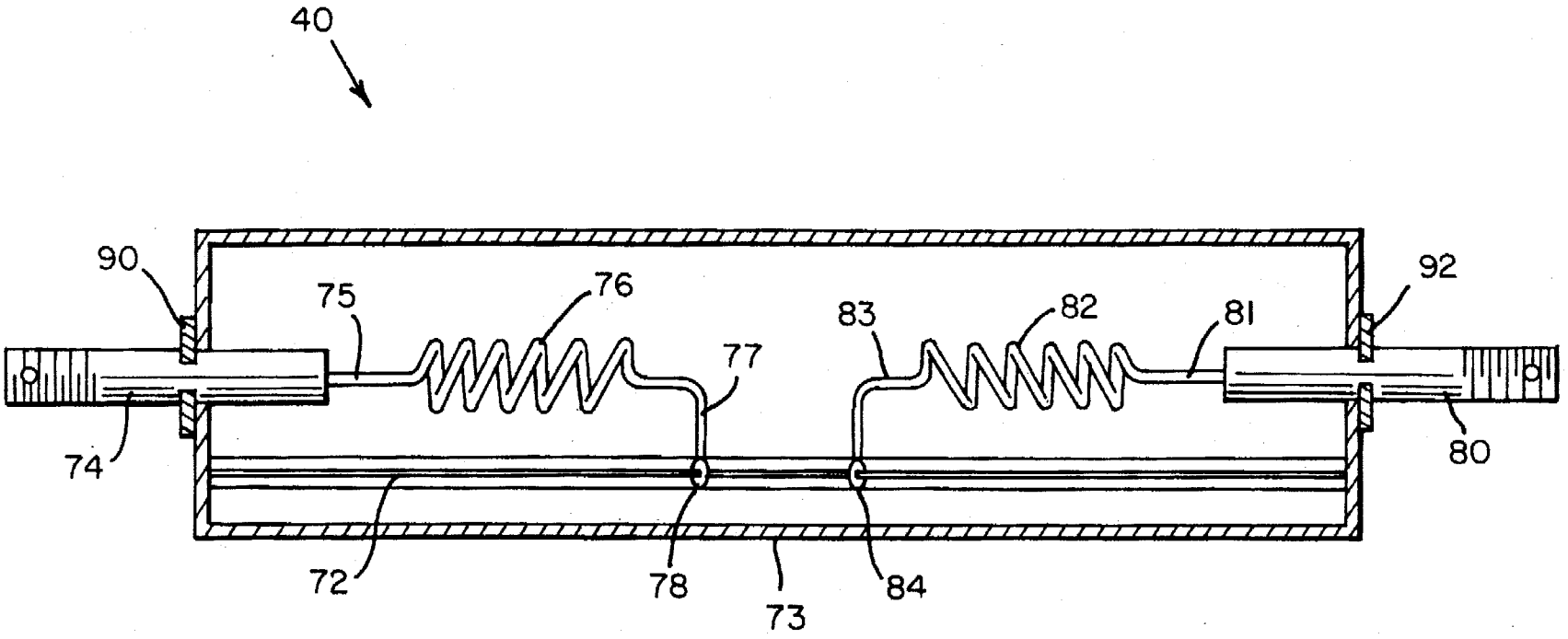
FIG. 5 is a sectional view of an adjustable link.

FIG. 5 shows the interior of adjustable link 40. Adjustable link 40 is the same as adjustable links 53, 140, 142, 164 and 166. Adjustable link 40 is one type of adjustable link that could be used in the apparatus 55 of FIG. 2 and apparatus 144 of FIG. 4.

The adjustable link 40 has a rod 72 fixed in body 73 of adjustable link 40. An end linkage member 74 is connected to one end 75 of a stretched spring 76. The other end 77 of the stretched spring 76 is slidably connected to rod 72 by a connector 78. Connector 78 may be slid along rod 72 and then fixedly attached to rod 72.

A tension force is formed on end linkage member 74 by streched spring 76. The tension force may be adjusted by sliding connector 78 along rod 72.

An end linkage member 80 is connected to one end 81 of a stretched spring 82. The other end 83 of the stretched spring 82 is connected to rod 72 by a connector 84. Connector 84 may be slid along rod 72 and then fixedly attached to rod 72. A tension force is formed on end linkage member 80 by streched spring 82. The tension force may be adjusted by sliding connector 84 along rod 72. Stops 90 and 92 prevent end linkage members 74 and 80 from going inside of the body 73 of adjustable link 40. Body 73 is formed in removable sections.

An adjustable link, such as link 40, creates a tension force that is transmitted to pressure pressure rollers, such as rollers 22, 24 26 and 28, and then to a cable, such as cable 14.

While the present invention has been disclosed in connection with the preferred embodiment thereof, it should be understood that there may be other embodiments which fall within the spirit and scope of the invention as defined by the following claims.

What is claimed is:

1. In combination, (a) a cable take-up drum having a cylindrical outer surface of a prescribed length;

(b) a cable wrapped around a portion of the length of the cable take-up drum; and (c) an apparatus for controlling said cable on said cable take-up drum, said apparatus comprising:

roller means for continually applying a pressure to the cable at a plurality of points that are uniformly around the take-up drum, the roller means extending substantially the length of the cable take-up drum; and first and second support means being respectively adjacent to first and second ends of the cable take-up drum for rotatably supporting the roller means, each of the first and second support means respectively having a single flexible spring steel member and first and second adjustable link means attached between two ends of the single spring steel flexible member for pulling the two ends of the single flexible member together with an adjustable force to cause the roller means to apply an adjustable pressure on the cable, the first and second support means encircling the cable take-up drum.

2. In combination, (a) a cable take-up drum having a cylindrical outer surface of a prescribed length;

(b) a cable wrapped around a portion of the length of the cable take-up drum;

(c) an apparatus for controlling said cable on said cable take-up drum, said apparatus comprising:

roller means for continually applying a pressure to the cable at a plurality of points that are uniformly around the take-up drum, the roller means extending substantially the length of the cable take-up drum;

first and second support means being respectively adjacent to first and second ends of the cable take-up drum for rotatably supporting the roller means, each of the first and second support means respectively having two attached flexible spring steel members and an adjustable link means attached between two ends of the two attached flexible spring steel members for pulling the two ends of the two attached flexible spring steel members together with an adjustable force to cause the roller means to apply an adjustable pressure on the cable, the first and second support means encircling the cable take-up drum; and a base means for preventing the first and second support means from rotating as the take-up drum rotates, the base means being adjacent to the length of the take-up drum.

* * * * *